US006749026B2

(12) United States Patent
Smith et al.

(10) Patent No.: US 6,749,026 B2
(45) Date of Patent: Jun. 15, 2004

(54) METHOD OF FORMING DOWNHOLE TUBULAR STRING CONNECTIONS

(75) Inventors: Ray C. Smith, Beaumont (CA); Neil Hepburn, Edmonton (CA)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/103,381

(22) Filed: Mar. 21, 2002

(65) Prior Publication Data

US 2003/0178197 A1 Sep. 25, 2003

(51) Int. Cl.[7] ..... E21B 43/10
(52) U.S. Cl. ..... 166/313; 166/380
(58) Field of Search ..... 166/313, 380

(56) References Cited

U.S. PATENT DOCUMENTS

| | | | | |
|---|---|---|---|---|
| 5,458,209 A | | 10/1995 | Hayes et al. | |
| 5,615,740 A | | 4/1997 | Comeau et al. | |
| 6,079,493 A | * | 6/2000 | Longbottom et al. | 166/313 |
| 6,089,320 A | | 7/2000 | LaGrange | |
| 6,135,208 A | | 10/2000 | Gano et al. | |
| 6,241,021 B1 | | 6/2001 | Bowling | |
| 6,325,148 B1 | | 12/2001 | Trahan et al. | |
| 6,457,532 B1 | * | 10/2002 | Simpson | 166/380 |

FOREIGN PATENT DOCUMENTS

| | | |
|---|---|---|
| FR | 2692316 | 12/1993 |
| GB | 2 345 308 A | 7/2000 |
| WO | WO 00/37768 A1 | 6/2000 |

OTHER PUBLICATIONS

Search Report for United Kingdom Application No.: GB 0305141.4, Jul. 8, 2003.

Sperry–Sun Multilateral Services Profile, "LRS–SL™ Self–Locating Lateral Re–Entry System", dated 2000.

Sperry–Sun Multilateral Services Profile, "LRW–SL™ Self–Locating Lateral Re–Entry Whipstock", dated 2000.

Sperry–Sun Multilateral Services Profile, "LRS™ Lateral Re–Entry System", dated 2000.

Sperry–Sun Multilateral Services Profile, "WREAL™ Wire-line Re–Entry Alignment System", dated 2000.

Sperry–Sun Multilateral Services Profile, "TEW™ Tubing Exit Whipstock", dated 2000.

Sperry–Sun Multilateral Services Profile, "LRW™ Lateral Re–Entry Whipstock", dated 2000.

Sperry–Sun Multilateral Services Profile, "TPI™ Through–Tubing Pressure Isolation Sleeve", dated 2000.

Sperry–Sun Multilateral Services Profile, "Vector Block", dated 2000.

Sperry–Sun Multilateral Services Profile, "RDS™ Re–Entry Drilling System" dated 2000.

Sperry–Sun Multilateral Services Profile, "Merlin™ Milled Exit Retrievable Multilateral System", dated 2000.

Sperry–Sun Multilateral Services Profile, "4502™ /4503™ Metal Mill–Through Systems", dated 2000.

Sperry–Sun Multilateral Services Profile, "RMLS™ Retrievable Multilateral System", dated 2000.

Sperry–Sun Multilateral Services Profile, "LTBS™ Lateral Tie–Back System", dated 2000.

(List continued on next page.)

*Primary Examiner*—David Bagnell
*Assistant Examiner*—Matthew J Smith
(74) *Attorney, Agent, or Firm*—Marlin R. Smith

(57) ABSTRACT

A method of forming a downhole connection between tubular strings includes the step of crimping the tubular strings together. The tubular strings may be positioned in the same wellbore, or the tubular strings may be positioned in different intersecting wellbores during the crimping step. One of the tubular strings may be expanded outwardly within the other tubular string prior to the crimping step.

39 Claims, 4 Drawing Sheets

OTHER PUBLICATIONS

Sperry–Sun Multilateral Services Profile, "PACE–6™ Pressure–Actuated Casing Exit System", dated 2000.
Sperry–Sun Multilateral Services Profile, "Sperry–Sun Latch Coupling", dated 2000.
Sperry–Sun Multilateral Services Profile, "4501™ Low–Side Perforation System", dated 2000.
Sperry–Sun Multilateral Services Profile, "MSCS® Multi–String Completion System", dated 2000.
Sperry–Sun Multilateral Services Profile, "ITBS™ Isolated Tie–Back System", dated 2000.
Sperry–Sun Multilateral Products, Services, and Solutions, dated 2000.

Pending U.S. Application: 10/122,424, filed Apr. 12, 2002, entitled Sealed Multilateral Junction System.

Pending U.S. Application: 10/103,025, filed Mar. 21, 2002, entitled Isolation Bypass Transition Joint.

"HOMCO Internal Steel Liner Casing Patch", Weatherford Fishing and Rental Tool Services, dated 1995.

* cited by examiner

METHOD OF FORMING DOWNHOLE TUBULAR STRING CONNECTIONS

BACKGROUND

The present invention relates generally to operations performed in conjunction with subterranean wells and, in an embodiment described herein, more particularly provides a method of forming connections between tubular strings downhole.

It is common practice to use a packer or other anchoring device, such as a liner hanger, to secure a liner to a casing string downhole. However, the use of such anchoring devices unduly restricts access and fluid flow through the casing. In addition, these conventional anchoring devices are costly and sometimes difficult to set in certain circumstances.

Some anchoring devices, such as packers, also provide sealing between the liner and the casing. However, this sealing engagement requires a substantial amount of annular space between the liner and the casing, to accommodate the mechanical setting apparatus of a typical packer. Thus, the liner drift diameter must be substantially less than the casing drift diameter.

Furthermore, conventional anchoring devices cannot be used with expandable tubular strings, such as casings or liners which are expanded downhole. For example, a typical packer is not designed to be expanded outward along with the tubular string in which it is interconnected.

From the foregoing, it can be seen that it would be quite desirable to provide an improved method of forming connections between tubular strings downhole, which method overcomes some or all of the above described deficiencies in the art.

SUMMARY

In carrying out the principles of the present invention, in accordance with an embodiment thereof, a method is provided for connecting tubular strings downhole. The method does not require the use of packers or other anchoring devices, yet the method secures the tubular strings to each other and provides a seal between the tubular strings.

In one aspect of the invention, a method is provided which includes the steps of installing a first tubular string in a wellbore, conveying a second tubular string into the first tubular string and then crimping the tubular strings to each other. The step of crimping the tubular strings together may form a metal to metal seal between the tubular strings. Alternatively, a sealing material may be positioned between the tubular strings. The sealing material may be compressed between the tubular strings in the crimping step.

In another aspect of the invention, the first and second tubular strings may be bonded to each other downhole. For example, a bonding agent, such as an adhesive, may be used between the tubular strings. The bonding agent may also serve to seal between the tubular strings. The bonding agent may be compressed between the tubular strings in the crimping step.

In yet another aspect of the invention, the second tubular string may be displaced through a window formed through a sidewall of the first tubular string. The crimping step may be performed on a portion of the second tubular string which remains within the first tubular string. The crimping step may be performed on an end of the second tubular string positioned at the window. The crimping step may be performed on a portion of the second tubular string extending laterally across a longitudinal bore of the first tubular string.

In still another aspect of the invention, the second tubular string may be expanded within the first tubular string. The first tubular string may also be an expandable string. Preferably, the first and second tubular strings have substantially equal inner drift diameters after the connection is formed between the tubular strings.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
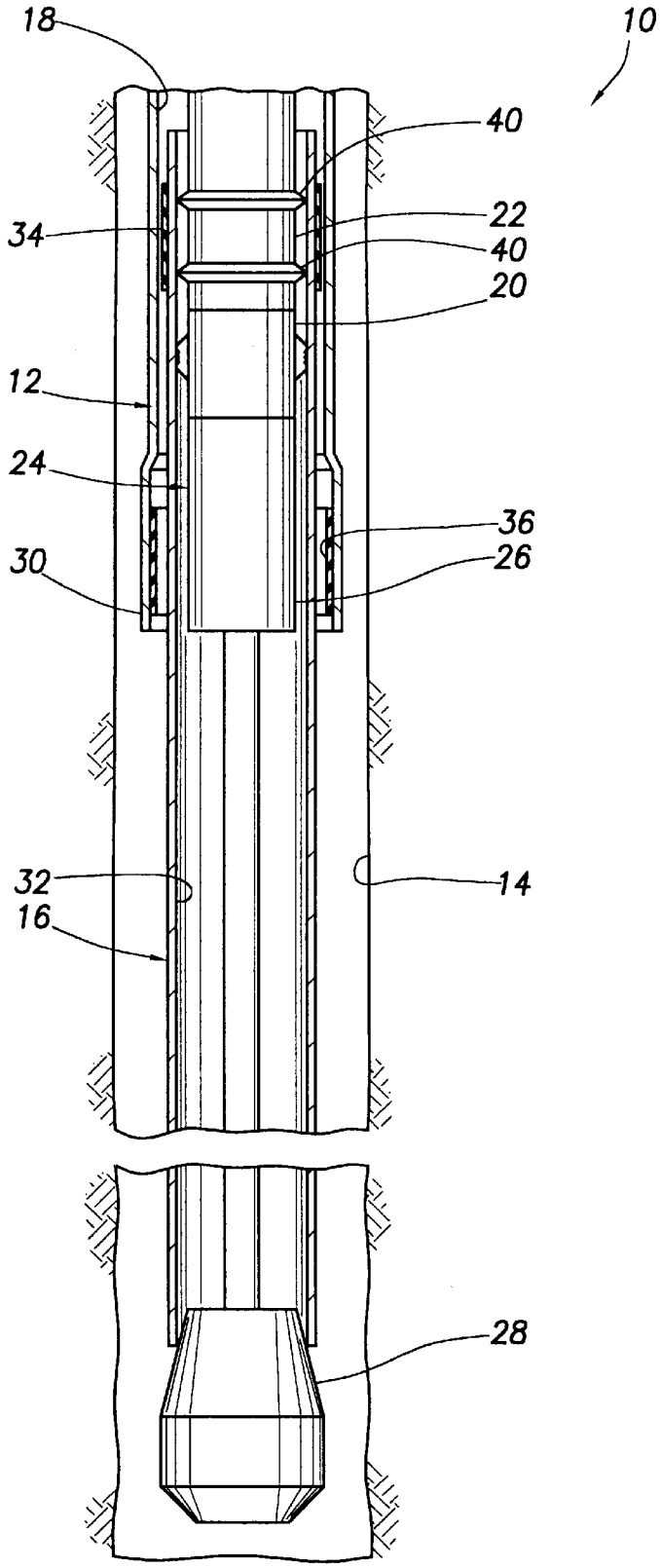
FIG. 1 is a schematic cross-sectional view of a first method of forming a connection between tubular strings downhole, the method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10 as depicted in FIG. 1, a tubular string, such as casing string 12, is installed in a wellbore 14, and then another tubular string, such as liner string 16, is conveyed into the wellbore. However, it is to be clearly understood that the casing and liner strings 12, 16 are merely representative of a wide variety of tubular strings which may be used in methods embodying principles of the invention. For example, both of the tubular strings could be casing strings or liner strings, or one or both of the tubular strings could be a production tubing string, etc. Thus, it will be appreciated that the invention is not limited by the specific details of the exemplary method 10 described herein.

The casing string 12 may be an expandable casing string, in which case it may be expanded outward prior to conveying the liner string 16 into the wellbore 14. In the embodiment of the method 10 shown in FIG. 1, the liner string 16 is actually conveyed through the casing string 12, and so it is desirable at this point for the liner string to have an outer diameter which is smaller than an inner drift diameter 18 of the casing string. However, it is not necessary in keeping with the principles of the invention for one tubular string to be conveyed through another tubular string.

The liner string 16 is conveyed through the casing string 12 using a running tool 20 which engages an inner side surface of the liner string. Attached above the running tool 20 is a crimping tool 22, and attached below the running tool is an expansion tool 24. The crimping tool 22 is used in the method 10 in forming a connection between the casing and liner strings 12, 16, as will be described more fully below.

The expansion tool 24 is used to expand the liner string 16 outward after it is properly positioned within the casing string 12. Specifically, the expansion tool 24 includes an actuator 26, such as an electric, hydraulic, mechanical, etc. actuator, which displaces a conically-shaped wedge 28 through the liner string 16 to outwardly expand the liner string. Other expansion devices, such as inflation-type devices, etc., may be used in place of the expansion tool 24, without departing from the principles of the invention.

Preferably, the liner string 16 is expanded within a radially enlarged lower end portion 30 of the casing string 12. In this manner, the liner string 16 may be expanded so that its inner drift diameter 32 is substantially equal to the inner drift diameter 18 of the casing string 12. Preferably, the liner string drift diameter 32 is no less than the casing string drift diameter 18 after the liner string 16 is expanded outward, but it may be smaller without departing from the principles of the invention.

Note that the liner string 16 could be conveyed into the wellbore 14 prior to conveying the casing string 12 into the wellbore. For example, the liner string 16 could be positioned in the wellbore 14 first, and then the casing string 12 could be installed in the wellbore so that the enlarged lower end 30 thereof passes over the upper end of the liner string. In that case, there would be no need to convey the liner string 16 through the casing string 12, and the method 10 would permit a bottom up assembly of tubular strings in the wellbore.

Carried externally on the liner string 16 is a material 34 which may be a sealing material and/or a bonding agent. Alternatively, or in addition, a material 36 may be carried internally on the casing string 12 at its lower end 30. Where the materials 34, 36 are sealing materials, they may be resilient materials, elastomers, nonelastomers, or any other type of sealing material which may be used to form a seal between the casing and liner strings 12, 16.

Where the materials 34, 36 are bonding agents, they may be adhesives or any other type of bonding agent which may be used to secure the casing and liner strings 12, 16 to each other. Of course, one type of material may serve more than one function. For example, an epoxy material, other polymer resin, etc. may serve to seal between the casing and liner strings 12, 16 and to bond the tubular strings together. It is, however, to be understood that the use of the materials 34, 36, or either of them, is not necessary in keeping with the principles of the invention.

Figure 2:
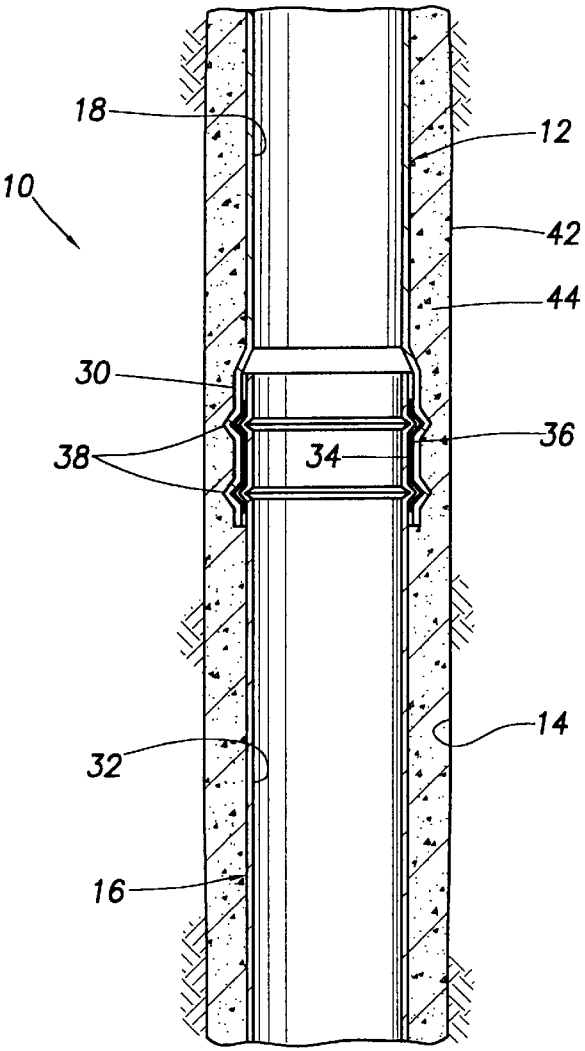
FIG. 2 is a schematic cross-sectional view of the first method, wherein further steps of the method have been performed.

Referring additionally now to FIG. 2, the method 10 is representatively illustrated wherein further steps of the method have been performed. The liner string 16 has been expanded outwardly after its upper end was positioned within the lower end 30 of the casing string 12, so that its drift diameter 32 is now substantially equal to the casing string 12 drift diameter 18. Thus, no substantial restriction to access or flow is presented through the connection between the casing and liner strings 12, 16.

After the liner string 16 was expanded, the crimping tool 22 was used to form multiple crimps 38 in the casing and liner strings. The crimping tool 22 forms the crimps 38 by outwardly displacing multiple dies 40 carried thereon (see FIG. 1). The dies 40 may be displaced outward in the same manner as slips on a packer are displaced outward, or in any other manner well known to those skilled in the art.

The dies 40 may form the crimps 38 as circumferentially extending corrugations, as depicted in FIG. 2, or the dies may be used otherwise in forming the connection between the casing and liner strings 12, 16, such as by forming folds, creases, notches, projections, etc. As used herein, the terms "crimp" and "crimping" are used broadly to designate any such manner in which one or more multiple elements are mechanically formed so that they securely engage each other. In an important aspect of the invention, this forming step is performed after the elements are positioned downhole.

The crimps 38 secure the casing and liner strings 12, 16 together. The crimps 38 may also serve to form a seal between the casing and liner strings 12, 16. For example, a metal to metal seal may be formed when the casing and liner strings 12, 16 are crimped together. Alternatively, or in addition, the materials 34, 36 may be compressed between the casing and liner strings 12, 16 when the crimps 38 are formed. If the materials 34, 36, or either of them, are a bonding agent, this compression between the casing and liner strings 12, 16 may serve to further secure the tubular strings to each other.

After the crimping step, cement 42 is flowed into an annulus 44 between the wellbore 14 and the casing and liner strings 12, 16. The relatively low outer profile of the connection between the casing and liner strings 12, 16, and the minimal, if any, inner restriction provided by the connection enhances the efficiency of the cementing operation. Other subsequent operations, such as production operations, are similarly enhanced by the connection provided by the present invention.

Figure 3:
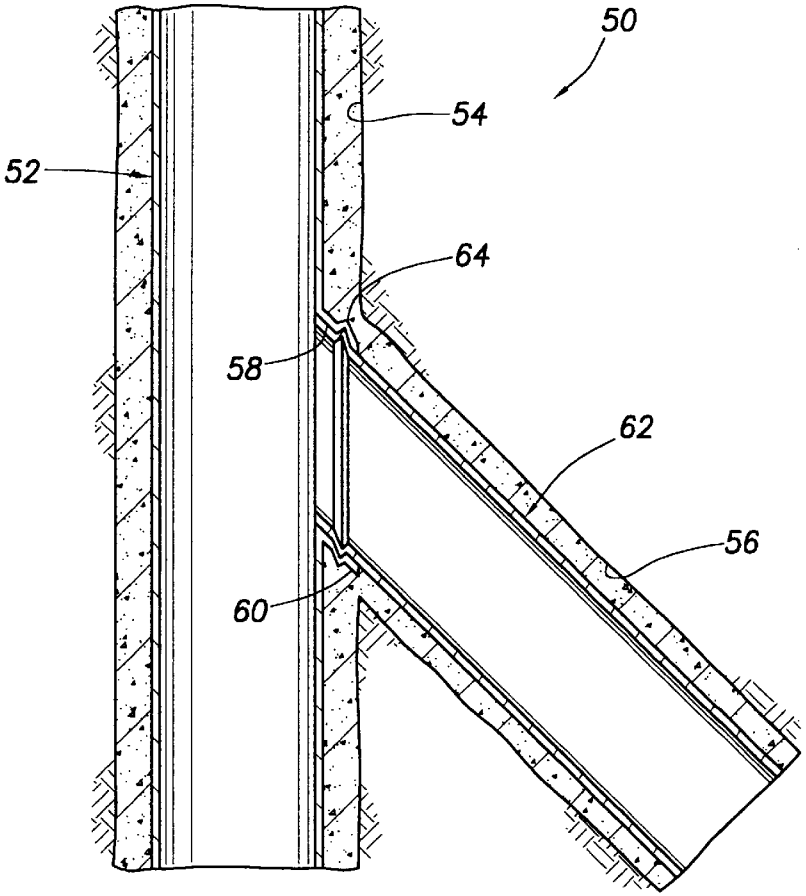
FIG. 3 is a schematic cross-sectional view of a second method embodying principles of the present invention.

Referring additionally now to FIG. 3, another method 50 embodying principles of the invention is representatively illustrated. In the method 50, a casing string 52 is installed in a parent wellbore 54 either prior to or subsequent to drilling a branch wellbore 56 intersecting the parent wellbore. The casing string 52 as depicted in FIG. 3 includes a window 58 formed through a sidewall thereof. The window 58 may be formed before or after the casing string 52 is installed in the wellbore 54.

The casing string 52 also includes a generally tubular flange 60 extending outward somewhat from the window 58. A liner string 62 is conveyed through the casing string 52, and outward through the window 58 into the branch wellbore 56. An upper end of the liner string 62 is positioned within the flange 60, and the upper end of the liner string is crimped to the flange 60, for example, using a crimping tool such as the crimping tool 22 described above.

As depicted in FIG. 3, only one crimp 64 has been formed, but multiple crimps may be formed as desired. The crimp 64 circumscribes the window 58. The crimp 64 may be formed prior to milling off an upper end of the liner string 62 extending into the interior of the casing string 52, to thereby stabilize the liner string during the milling process.

Alternatively, the upper end of the liner string 62 may be preformed so that it does not extend significantly into the casing string 52 during the crimping step (as depicted in FIG. 3), and no milling process may be necessary. In that case, the liner string 62 would be noncoaxial with any portion of the casing string 52 internal to the window 58 during the crimping step.

The crimp 64 may form a seal between the casing and liner strings 52, 62, for example, by forming a metal to metal seal therebetween. Alternatively, or in addition, materials such as the materials 34, 36 described above may be used to seal between the casing and liner string 52, 62 and/or to secure the tubular strings together.

The liner string 62 may be an expandable liner string, in which case it may be expanded as described above for the liner string 16. For example, the liner string 62 may be expanded outward after it is positioned in the branch wellbore 56 with its upper end within the flange 60. The casing string 52 could also be expandable, in which case it is preferably expanded outward prior to conveying the liner string 62 through the casing string.

Figure 4:
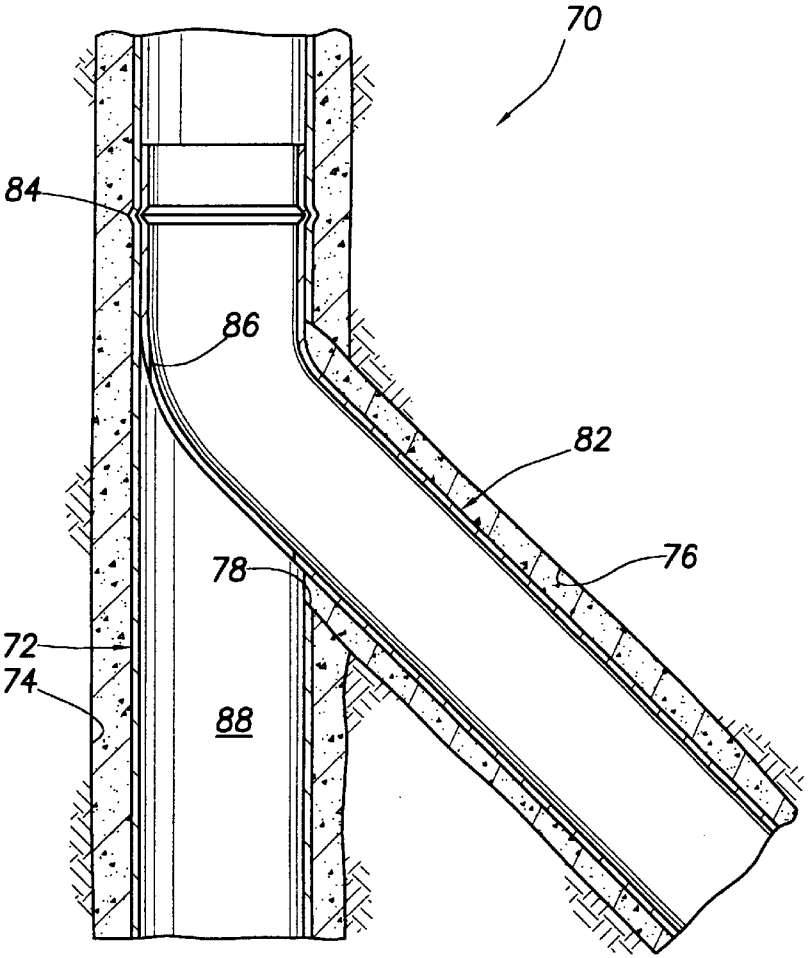
FIG. 4 is a schematic cross-sectional view of a third method embodying principles of the present invention.

Referring additionally now to FIG. 4, another method 70 embodying principles of the invention is representatively illustrated. In the method 70, a casing string 72 is installed in a parent wellbore 74 either prior to or subsequent to drilling a branch wellbore 76 intersecting the parent wellbore. The casing string 72 as depicted in FIG. 4 includes a window 78 formed through a sidewall thereof. The window 78 may be formed before or after the casing string 72 is installed in the wellbore 74.

A liner string 82 is conveyed through the casing string 72, and outward through the window 78 into the branch wellbore 76. An upper end of the liner string 82 is positioned longitudinally and coaxially within the casing string 72 above the window 78, and the upper end of the liner string is crimped therein, for example, using a crimping tool such as the crimping tool 22 described above.

As depicted in FIG. 4, only one crimp 84 has been formed, but multiple crimps may be formed as desired. The crimp 84 may form a seal between the casing and liner strings 72, 82, for example, by forming a metal to metal seal therebetween. Alternatively, or in addition, materials such as the materials 34, 36 described above may be used to seal between the casing and liner strings 72, 82 and/or to secure the tubular strings together.

The liner string 82 may be an expandable liner string, in which case it may be expanded as described above for the liner string 16. For example, the liner string 82 may be expanded outward after it is positioned in the branch wellbore 76 with its upper end within the casing string 72. The casing string 72 could also be expandable, in which case it is preferably expanded outward prior to conveying the liner string 82 through the casing string.

To provide access and/or fluid communication through the casing string 72, one or more openings 86 may be formed through a sidewall of the liner string 82 where it extends laterally across an internal longitudinal flow passage 88 of the casing string. The opening 86 may be formed through the liner string 82 sidewall after the liner string is conveyed into the branch wellbore 76, for example, after the crimp 84 is formed, or the opening may be preformed in the liner string prior to conveying it into the well.

Figure 5:
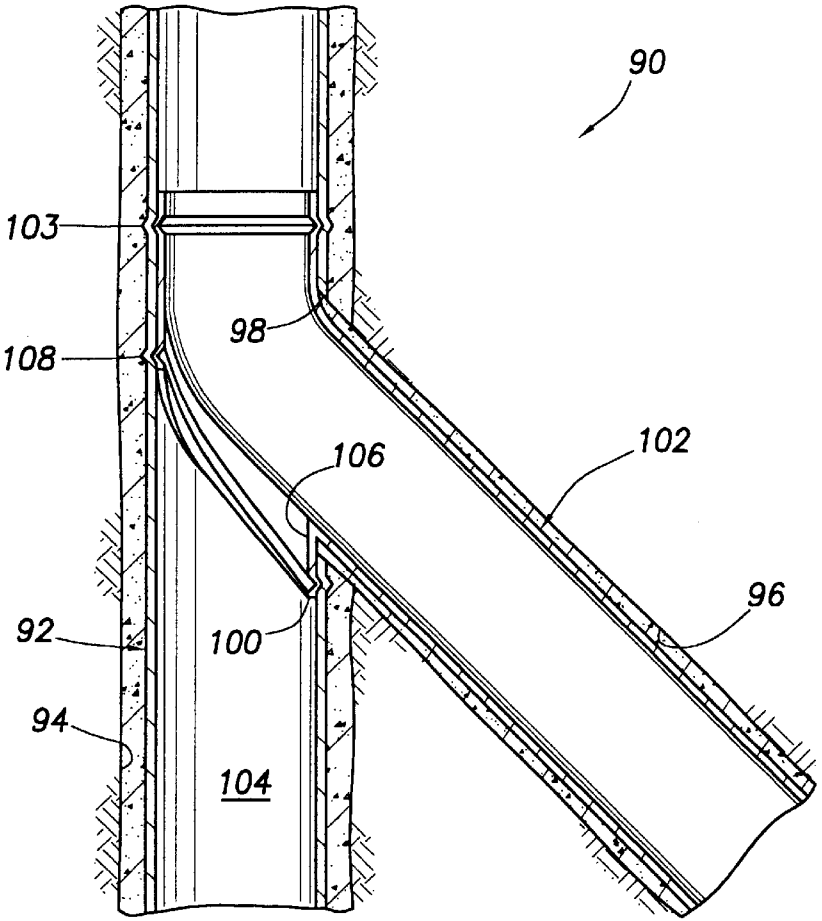
FIG. 5 is a schematic cross-sectional view of a fourth method embodying principles of the present invention.

Referring additionally now to FIG. 5, another method 90 embodying principles of the invention is representatively illustrated. In the method 90, a casing string 92 is installed in a parent wellbore 94 either prior to or subsequent to drilling a branch wellbore 96 intersecting the parent wellbore. The casing string 92 as depicted in FIG. 5 includes a window 98 formed through a sidewall thereof. The window 98 may be formed before or after the casing string 92 is installed in the wellbore 94.

A liner string 102 is conveyed through the casing string 92, and outward through the window 98 into the branch wellbore 96. An upper end of the liner string 102 is positioned longitudinally and coaxially within the casing string 92. The upper end of the liner string 102 may be secured and/or sealed to the casing string 92 using one or more crimps 103, similar to the crimp 84 in the method 70 described above.

The liner string 92 includes a generally tubular flange 100 extending downward somewhat from an opening 106 formed through a sidewall of the liner string 102 where it extends laterally across an inner longitudinal flow passage 104 of the casing string 92. The flange 100 and opening 106 may be formed before or after the liner string 102 is conveyed into the well.

The flange 100 is crimped to the casing string 92, for example, using a crimping tool such as the crimping tool 22 described above. As depicted in FIG. 5, only one crimp 108 has been formed, but multiple crimps may be formed as desired. The crimp 108 extends circumferentially about the opening 106, so that it circumscribes the opening.

The crimp 108 may form a seal between the casing and liner strings 92, 102, for example, by forming a metal to metal seal therebetween. Alternatively, or in addition, materials such as the materials 34, 36 described above may be used to seal between the casing and liner string 92, 102 and/or to secure the tubular strings together. The crimp 108 may be formed before, after, or at the same time as the crimp 103.

The liner string 102 may be an expandable liner string, in which case it may be expanded as described above for the liner string 16. For example, the liner string 102 may be expanded outward after it is positioned in the branch wellbore 96 with its upper end within the casing string 92. The casing string 92 could also be expandable, in which case it is preferably expanded outward prior to conveying the liner string 102 through the casing string.

Figure 6B:
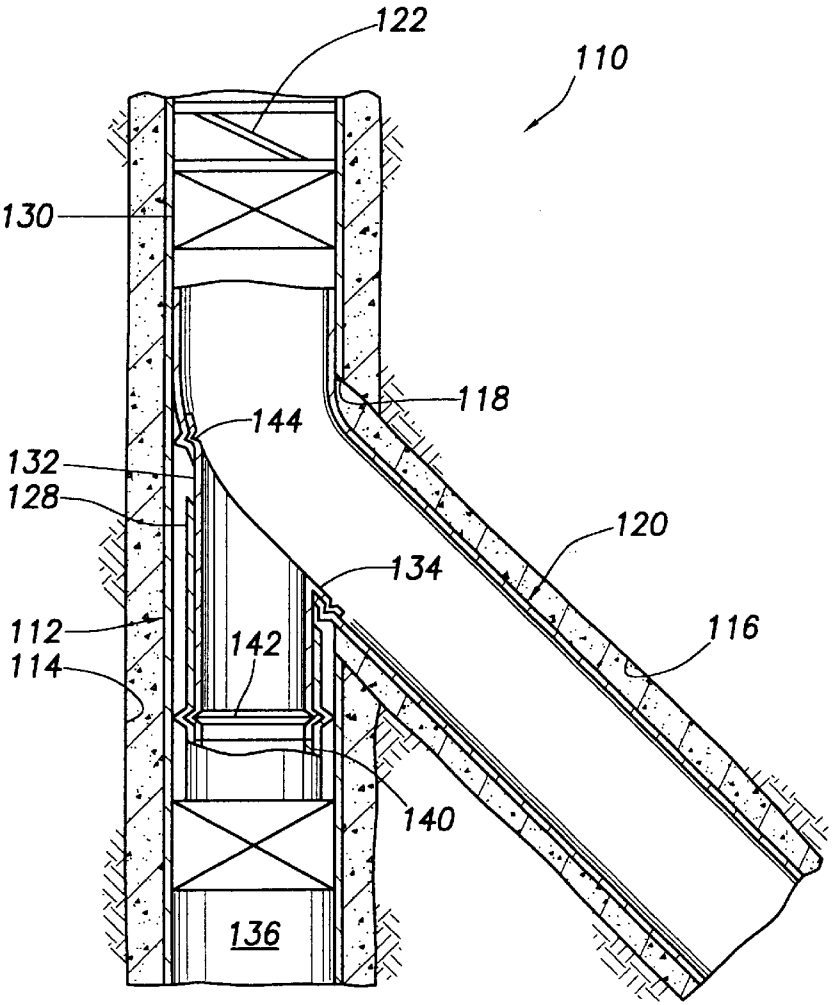
FIGS. 6A & 6B are schematic cross-sectional views of a fifth method embodying principles of the present invention.
Figure 6A:
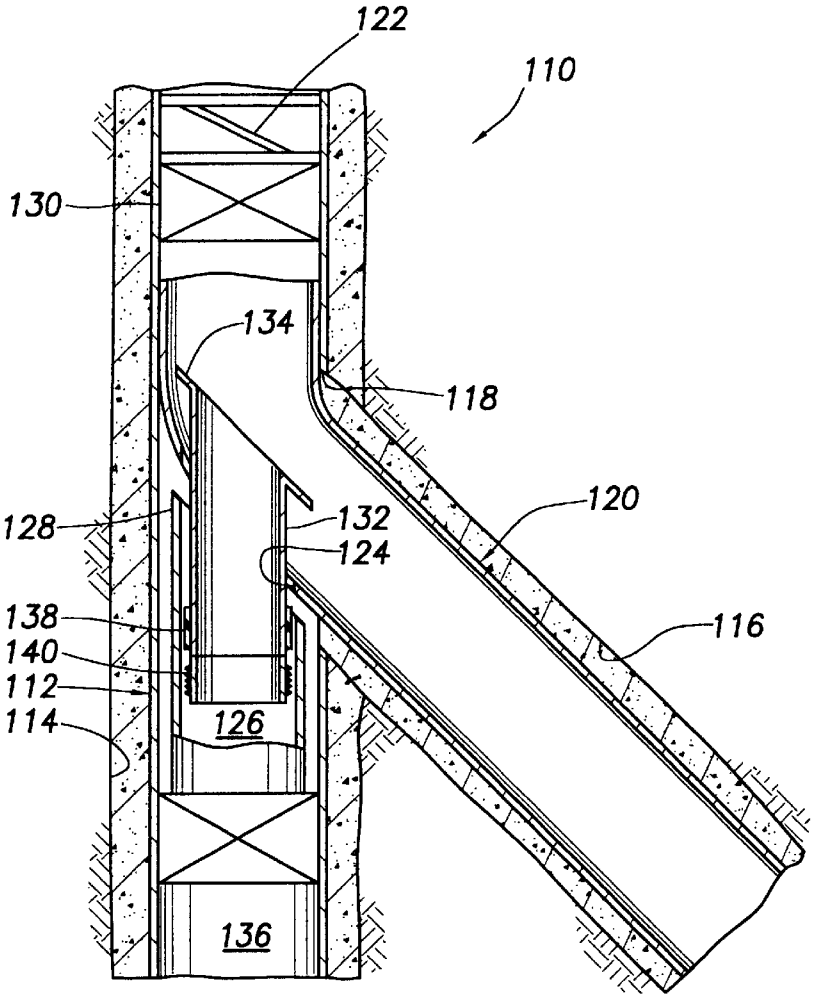

Referring additionally now to FIGS. 6A & B, another method 110 embodying principles of the invention is representatively illustrated. In the method 110, a casing string 112 is installed in a parent wellbore 114 either prior to or subsequent to drilling a branch wellbore 116 intersecting the parent wellbore. The casing string 112 as depicted in FIG. 6A includes a window 118 formed through a sidewall thereof. The window 118 may be formed before or after the casing string 112 is installed in the wellbore 114.

A liner string 120 is conveyed through the casing string 112, and outward through the window 118 into the branch wellbore 116. An upper end of the liner string 120 is positioned longitudinally and coaxially within the casing string 112 above the window 118.

A running tool (not shown) for the liner string 120 engages an orienting profile 122 in the casing string 112. The orienting profile 122 rotationally orients the liner string 120 so that an opening 124 formed laterally through a sidewall of the liner string is aligned with an inner longitudinal bore 126 of a deflection device 128 positioned in the casing string 112 below the window 118. The deflection device 128 is used to deflect the liner string 120 from the parent wellbore 114 into the lateral wellbore 116 via the window 118 as the liner string is lowered in the casing string 112.

The opening 124 provides access and/or fluid communication through the casing string 112 where the liner string 120 extends laterally across an internal longitudinal flow passage 136 of the casing string. The opening 124 may be formed through the liner string 120 sidewall after the liner string is conveyed into the branch wellbore 116, or the opening may be preformed in the liner string prior to conveying it into the well.

When the liner string 120 is properly positioned in the lateral wellbore 116 with the upper end of the liner string in the casing string 112 above the window 118, and with the opening 124 aligned with the bore 126 of the deflection device 128, a liner hanger 130 attached to the upper end of the liner string is set in the casing string. The liner hanger 130 anchors the liner string 120 in position and seals between the liner and casing strings. Alternatively, one or more crimps could be used for this purpose, such as the crimp 84 in the method 70 described above.

The liner string 120 may be expandable, in which case it would preferably be expanded outward after it is properly positioned. Expansion of the liner string 120 may be accomplished by means of the running tool used to convey the liner string into the well, or another tool may be used to expand the liner string. The casing string 112 could also be expandable, in which case it is preferably expanded outward prior to conveying the liner string 120 through the casing string.

A generally tubular sleeve 132 is then inserted through the opening 124 and into the bore 126 of the deflection device 128 from within the liner string 120. The sleeve 132 includes an upper radially outwardly extending flange 134 which is shaped to conform to the interior of the liner string 120 about the opening 124. If the liner string 120 is expandable, then preferably the liner string is expanded prior to inserting the sleeve 132 through the opening 124.

A seal 138 may be carried externally on the sleeve 132 for sealing engagement with the bore 126 of the deflection device 128. The seal 138 may be any type of conventional seal, such as o-rings, packing, etc., or the seal may be a sealing and/or bonding material similar to the materials 34, 36 described above. The sleeve 132 may be expandable, in which case the seal 138 may be compressed between the sleeve and the deflection device 128 in the bore 126 when the sleeve is expanded outward.

An anchoring device 140 may be attached to the sleeve 132 for securing the sleeve in position in the deflection device 128. For example, the anchoring device 140 may be a RatchLatch® available from Halliburton Energy Services, Inc. of Houston, Tex. The anchoring device 140 preferably permits the sleeve 132 to be inserted into the bore 126, but prevents the sleeve from being withdrawn from the bore.

As depicted in FIG. 6B, the sleeve 132 has been inserted into the bore 126 sufficiently far, so that the upper flange 134 contacts the interior surface of the liner string 120 about the opening 124. If provided, the seal 138 may now be sealingly engaged within the deflection device 128, and the anchoring device 140 may secure the sleeve 132 in position, so that the flange 134 remains in contact with the interior surface of the liner string 120 about the opening 124.

If the sleeve 132 is expandable, then preferably it is expanded outward after it is positioned in the bore 126 of the deflection device 128. This expansion of the sleeve 132 may be used to bring the seal 138 into sealing engagement with the bore 126. Expansion of the sleeve 132 may be accomplished using the running tool used to convey the liner string 120 into the well, or another expansion tool may be used, such as the expansion tool 24 described above.

To secure and/or seal the sleeve 132 within the deflection device 128, one or more crimp(s) 142 may be formed in the sleeve and deflection device. The crimp 142 may be used in place of, or in addition to, either of the seal 138 and the anchoring device 140. If the seal 138 is used, the seal may be compressed between the sleeve 132 and the deflection device 128 when the crimp 142 is formed. A metal-to-metal seal may be formed between the sleeve 132 and the deflection device 128, for example, if the seal 138 is not used.

The crimp 142 may be formed by the running tool used to convey the liner string 120 into the well, or another crimping tool may be used, such as the crimping tool 22 described above. Note that the crimp 142 is not necessary, since the seal 138 and anchoring device 140 may perform the functions of securing and sealing the sleeve 132 in the deflection device 128. However, any combination of the crimp 142, the seal 138 and the anchoring device 140 may be used in keeping with the principles of the invention.

One or more crimp(s) 144 may be used to secure and/or seal the flange 134 to the liner string 120 about the opening 124. The crimp 144 extends circumferentially about the opening 124 and, thus, circumscribes the opening.

A sealing and/or bonding material, such as the materials 34, 36 described above, may be used between the flange 134 and the inner surface of the liner string 120. If such a material is used, it may be compressed between the flange 134 and the inner surface of the liner string 120 when the crimp 144 is formed. A metal-to-metal seal may also, or alternatively, be formed between the flange 134 and the inner surface of the liner string 120 when the crimp 144 is formed.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. For example, in the method 50 described above, the flange 60 could be formed on the liner string 62, instead of being formed on the casing string 52. Accordingly, the foregoing detailed description is to be clearly understood as being given by way of illustration and example only, the spirit and scope of the present invention being limited solely by the appended claims and their equivalents.

What is claimed is:

1. A method of forming a connection between first and second tubular strings downhole, the method comprising the steps of:

installing the first tubular string in a first wellbore;

conveying the second tubular string into the first tubular string; and then crimping the first and second tubular strings together, thereby securing the second tubular string to the first tubular string, the second tubular string being conveyed downhole prior to conveying the first tubular string downhole.

2. A method of forming a connection between first and second tubular strings downhole, the method comprising the steps of:

installing the first tubular string in a first wellbore;

conveying the second tubular string into the first tubular string; and then crimping the first and second tubular strings together, thereby securing the second tubular string to the first tubular string, the conveying step further comprising conveying the second tubular string through a window formed through a sidewall of the first tubular string, and the crimping step further comprising crimping the first and second tubular strings together circumscribing the window.

3. A method of forming a connection between first and second tubular strings downhole, the method comprising the steps of:

installing the first tubular string in a first wellbore;

conveying the second tubular string into the first tubular string; and then crimping the first and second tubular strings together, thereby securing the second tubular string to the first tubular string, the conveying step further comprising conveying the second tubular string through a window formed through a sidewall of the first tubular string, and in the conveying step a portion of the second tubular string extends laterally across the first tubular string, and wherein the crimping step further comprises crimping the portion of the second tubular string to the first tubular string.

4. The method according to claim 3, further comprising the step of forming an opening through a sidewall of the portion of the second tubular string, the opening providing fluid communication through the first tubular string, and wherein the crimping step further comprises crimping the first and second tubular strings together circumscribing the opening.

5. A method of forming a connection between first and second tubular strings downhole, the method comprising the steps of:

installing the first tubular string in a first wellbore;

conveying the second tubular string into the first tubular string and then crimping the first and second tubular strings together, thereby securing the second tubular string to the first tubular string; and outwardly expanding the second tubular string, the expanding step being performed after the conveying step and prior to the crimping step.

6. A method of forming a connection between first and second tubular strings downhole, the method comprising the steps of:

installing the first tubular string in a first wellbore;

conveying the second tubular string into the first tubular string;

displacing the second tubular string through a window formed through a sidewall of the first tubular string; and then crimping the first and second tubular strings together, thereby securing the second tubular string to the first tubular string, the crimping step further comprising crimping an end Of the second tubular string to a portion of the first tubular string extending outwardly from the window.

7. The method according to claim 6, wherein in the crimping step, the first tubular string portion is generally tubular and outwardly overlaps the second tubular string.

8. The method according to claim 6, wherein in the crimping step, the second tubular string is noncoaxial with any portion of the first tubular string internal to the window.

9. A method of forming a connection between first and second tubular strings downhole, the method comprising the steps of:

installing the first tubular string in a first wellbore;

conveying the second tubular string into the first tubular string;

displacing the second tubular string through a window formed through a sidewall of the first tubular string; and then crimping the first and second tubular strings together, thereby securing the second tubular string to the first tubular string, the displacing step further comprising leaving a portion of the second tubular string extending laterally across a longitudinal bore of the first tubular string.

10. The method according to claim 9, wherein the crimping step further comprises crimping the second tubular string portion to the first tubular string.

11. The method according to claim 10, wherein the crimping step further comprises crimping about an opening formed through the second tubular string portion.

12. The method according to claim 11, wherein the second tubular string portion includes a flange circumscribing the opening, and wherein the crimping step further comprises crimping the flange to the first tubular string.

13. A method of forming a connection between first and second tubular strings downhole, the method comprising the steps of:

installing the first tubular string in a first wellbore;

conveying the second tubular string into the first tubular string;

displacing the second tubular string through a window formed through a sidewall of the first tubular string;

displacing a structure through an opening in a sidewall of the second tubular string; and sealing the structure between the second tubular string and the first tubular string.

14. The method according to claim 13, wherein in the structure displacing step a portion Of the second tubular string is positioned within the first tubular string.

15. The method according to claim 14, wherein in the structure displacing step the second tubular string portion is generally coaxial with the first tubular string.

16. The method according to claim 13, wherein the structure displacing step further comprises displacing the structure into a deflection device positioned in the first tubular string.

17. The method according to claim 16, wherein the sealing step further comprises sealingly engaging the structure in a bore Of the deflection device.

18. The method according to claim 16, wherein the sealing step further comprises crimping the structure to the deflection device.

19. The method according to claim 16, wherein the sealing step further comprises compressing a sealing material between the structure and the deflection device.

20. The method according to claim 16, wherein the sealing step further comprises positioning a sealing material between the structure and the deflection device.

21. The method according to claim 16, wherein the sealing step further comprises forming a metal to metal seal between the structure and the deflection device.

22. The method according to claim 16, further comprising the step of anchoring the structure to the deflection device.

23. The method according to claim 22, wherein the anchoring step further comprises crimping the structure to the deflection device.

24. The method according to claim 22, wherein the anchoring step further comprises forming a gripping engagement between the structure and the deflection device using an anchoring device.

25. The method according to claim 22, wherein the anchoring step further comprises positioning a bonding agent between the structure and the deflection device.

26. The method according to claim 22, wherein the anchoring step further comprises crimping the structure to the second tubular string.

27. The method according to claim 16, wherein the structure is generally tubular with a radially enlarged flange, and wherein the structure displacing step further comprises engaging the flange with the second tubular string about the opening.

28. The method according to claim 27, wherein in the engaging step the structure flange is complementarily shaped relative to an interior of the second tubular string about the opening.

29. The method according to claim 27, wherein the engaging step further comprises sealing the flange to the second tubular string about the opening.

30. The method according to claim 29, wherein the flange sealing step further comprises crimping the flange to the second tubular string.

31. The method according to claim 29, wherein the flange sealing step further comprises compressing a sealing material between the flange and the second tubular string.

32. The method according to claim 29, wherein the flange sealing step further comprises positioning a sealing material between the flange and the second tubular string.

33. The method according to claim 29, wherein the flange sealing step further comprises forming a metal to metal seal between the flange and the second tubular string.

34. The method according to claim 27, further comprising the step of anchoring the flange to the second tubular string.

35. The method according to claim 34, wherein the anchoring step further comprises crimping the flange to the second tubular string.

36. The method according to claim 34, wherein the anchoring step further comprises positioning a bonding agent between the flange and the second tubular string.

37. The method according to claim 13, further comprising the step of expanding the structure after the structure displacing step.

38. The method according to claim 37, wherein the expanding step further comprises expanding the structure within a deflection device positioned in the first tubular string.

39. The method according to claim 37, wherein the expanding step further comprises compressing a sealing material against the structure.

* * * * *